US007185459B2

(12) United States Patent
Fronz et al.

(10) Patent No.: US 7,185,459 B2
(45) Date of Patent: Mar. 6, 2007

(54) LOCKING AND UNLOCKING DEVICE FOR VEHICLE DOORS, IN PARTICULAR SWINGING SLIDING DOORS FOR RAIL VEHICLES

(75) Inventors: Reinhard Fronz, Dessau (DE); Wolfgang Steiniger, Geesthacht (DE)

(73) Assignee: Fahrzeugtechnik Dessau AG, Dessau (DE)

( * ) Notice: Subject to any disclaimer, the term of this patent is extended or adjusted under 35 U.S.C. 154(b) by 181 days.

(21) Appl. No.: 10/987,690

(22) Filed: Nov. 12, 2004

(65) Prior Publication Data

US 2006/0103139 A1 May 18, 2006

(51) Int. Cl.

| | |
|---|---|
| ***E05B 55/00*** | (2006.01) |
| ***E05F 1/00*** | (2006.01) |
| ***E05F 3/00*** | (2006.01) |
| ***E05C 7/00*** | (2006.01) |
| ***E05C 9/16*** | (2006.01) |
| ***E05C 19/10*** | (2006.01) |

(52) U.S. Cl. ..... 49/449; 292/26

(58) Field of Classification Search ..... 292/26, 292/DIG. 32, 126, 50, 125, 123, 201; 49/449, 49/209, 210, 213

See application file for complete search history.

(56) References Cited

U.S. PATENT DOCUMENTS 1,647,225 A * 11/1927 Hicks ..... 105/395
4,015,866 A * 4/1977 Marsh et al. ..... 292/36
5,722,272 A * 3/1998 Bridgeman et al. ..... 70/264
5,722,704 A * 3/1998 Chaput et al. ..... 292/26
5,755,060 A * 5/1998 Zweili ..... 49/449

FOREIGN PATENT DOCUMENTS

| | | |
|---|---|---|
| AT | 392 117 B | 1/1991 |
| DE | 38 08 390 A1 | 10/1988 |
| DE | 101 16 580 A1 | 10/2002 |
| DE | 101 16 583 A1 | 10/2002 |
| EP | 0 280 677 B1 | 8/1988 |
| GB | 2 202 897 A | 10/1988 |

* cited by examiner

*Primary Examiner*—Brian E. Glessner
(74) *Attorney, Agent, or Firm*—Laurence A. Greenberg; Werner H. Stemer; Ralph E. Locher

(57) ABSTRACT

An engagement element is provided on the inside of the door leaf or of the door at a defined distance from the inside of the door. A spring-loaded locking hasp lies horizontally opposite the engagement element on the inside of the door frame. The locking hasp has a semicircular or claw-shaped recess and a laterally projecting locking section. A locking element is movably guided inside the door frame and connected to a vertically movable rod. During the closing movement of the door, the engagement element engages with the recess of the locking hasp, which swings with its locking section in the direction of the center of the door opening and assumes a position parallel to the door and is locked in this position by a movement of the locking element which is triggered in the vertical direction.

14 Claims, 5 Drawing Sheets

LOCKING AND UNLOCKING DEVICE FOR VEHICLE DOORS, IN PARTICULAR SWINGING SLIDING DOORS FOR RAIL VEHICLES

BACKGROUND OF THE INVENTION

Field of the Invention

The invention relates to a locking and unlocking device for (single wing or dual wing) vehicle doors, in particular for the swinging sliding doors of rail vehicles. The device is located on the vertical longitudinal side of at least one closing edge and has at least one horizontally arranged spring-loaded locking hasp which interacts with a movable locking element.

Swinging sliding doors for rail vehicles are known in a variety of embodiments. All the known swinging sliding doors have in common the fact that they can be moved out of the closed position by a transverse or swinging movement into a position which is ready for opening, and subsequently moved parallel to the outer wall of the vehicle into a position which clears the door opening. In the closed position, the door must be pulled firmly against the door seal and locked in this position.

It is already known to embody the locking devices as rotary latches, one rotary latch being arranged in the upper region and one in the lower region of the door guide. The rotary latches which are arranged in the manner of a pivot joint are activated by way of special control levers and engage in corresponding catch bolts for locking purposes.

Austrian patent AT 392 117 B discloses a locking device for swinging sliding doors in which components that are used to swing the door are also used for locking. The locking elements have, on their arms, brackets which run in blocked box-shaped guide rails of the door leaf.

German published patent application DE 38 08 390 A1 discloses a door lock for swinging sliding doors in which pivotable hooks are arranged on both inner sides of the door frame. The hooks latch into catches on the door leaf when the door closes.

It is also known—from European patent EP 0 280 677 B1—to arrange locking hasps about a vertical axis. The locking hasps are not activated until the door has closed and they interact with a pressing face that extends approximately perpendicularly to an inclined direction. The locking hasps are moved by way of a roller and an activation element, the locking hasps being pressed against the door, and thus counter to the force of the seal, and locking the door by means of their shape.

The disadvantage of these prior art locking systems is that they have a complicated design and are thus costly to manufacture and mount.

Commonly assigned German published patent application DE 101 16 583 A1 discloses a further locking and unlocking device for vehicle doors. Spring-loaded locking hasps having two functional elements lying opposite one another are arranged on the inside of the door, one functional element being able to engage in a vertical drive shaft which is arranged on the wagon body, and the other functional element interacting with a vertically movable locking element which is arranged on the end side of the door edge and is embodied as rollers.

The disposition of the movable locking and unlocking elements on the inside of the door requires either a door with a relatively wide fold on the rear side or a guide for the door at a relatively large distance from the outer wall of the vehicle.

SUMMARY OF THE INVENTION

It is accordingly an object of the invention to provide a locking and unlocking device for vehicle doors, in particular swinging sliding doors for rail vehicles which overcomes the above-mentioned disadvantages of the heretofore-known devices and methods of this general type and which requires a low level of expenditure on manufacturing and mounting, ensures a reliable lock, and is suitable for a variety of different designs of doors.

With the foregoing and other objects in view there is provided, in accordance with the invention, a locking and unlocking device for a vehicle door, such as a door of a rail vehicle, and configured for a one-wing or multi-wing door configuration. The device comprises:

at least one engagement element disposed on an inside of the door and at a defined spacing distance from the inside of the door;

a spring-loaded locking hasp disposed horizontally opposite the engagement element inside the door frame, the locking hasp having a semicircular or claw-shaped recess formed therein and a locking section protruding laterally over the recess;

a locking element movably guided on an inside of the door frame and connected to at least one rod movably disposed in a vertical direction;

wherein, during a closing movement of the door, the engagement element engages with the recess of the locking hasp and, as a result of the pressing movement of the door, the locking section of the locking hasp swings in a direction of a center of a door opening and the locking hasp assumes a position parallel to the door and is locked in the position by a movement of the locking element that is triggered in the vertical direction.

In other words, for the purpose of locking and unlocking, at least one engagement element, preferably a vertically guided roller, is arranged on the inside of the respective door leaf or of the door at a defined distance from the inside of the door. Opposite the engagement element there is, on the inside of the door frame, a horizontally arranged spring-loaded locking hasp. The latter has a semicircular or claw-shaped recess and a locking section which protrudes laterally over the recess. The actual locking element, which is preferably embodied as a bracket, is movably guided on the inside of the door frame and is connected to at least one rod which can be moved in the vertical direction. During the closing movement of the door leaves or of the door, the engagement element which is located on the door engages with the recess of the locking hasp. As a result of the pressing movement of the door leaf or of the door, the locking hasp swings with its locking section in the direction of the center of the door opening and assumes a position extending parallel to the door leaf. As a result of movement of the locking element which is triggered in the vertical direction, the locking hasp is locked, and thus also the door. The locking hasp can be mounted either in a mount which is attached to the inside of the door frame or on the vertical drive shaft or connecting shaft.

The locking element, the bracket, is rotatably mounted on a horizontally arranged shaft by its bent section in a mount which is attached to the inside of the door frame, the bracket being mounted in such a way that the opening of the bracket points in the direction of the door leaf. One of the two limbs of the bracket, preferably the upper one, has an angled portion which is directed toward the opening of the bracket and on which a roller is rotatably mounted on a horizontally arranged shaft. At least the upper limb is connected to a rod which can be moved in the vertical direction. The bracket is held in a defined position by a traction spring which is coupled to the mount. When a multiple lock is arranged, the individual brackets are movably connected to one another by means of vertically aligned rods which are coupled to the limbs. The movement of the locking hasp in the clockwise direction is limited by a stop which is provided on the mount.

If the locking hasp is mounted on the vertical drive shaft or connecting shaft, a traction spring, which is connected to the mount of the bracket, is coupled to it. The engagement element, for example a roller, which is arranged on the door or the door leaf is held in a mount which is provided for that purpose.

The activation of the rod which can be moved in the vertical direction, and thus also of the locking brackets, can be triggered by a separate drive or else by the reaction force of the drive for the transverse displacement and longitudinal displacement of the door or door leaves. In the last-mentioned variant, a segment plate, whose rotational movement is limited by two stops, is attached to the rotatable housing of the drive motor. The traction rod, which transmits the rotational movement to a spring-loaded pivoted lever which is rigidly connected to a shaft at its axis of rotation, engages on the segment plate. At the lower end of the shaft, a lever is attached which is connected to at least one horizontally arranged coupling rod which is coupled to a hinged plate which is arranged in the upper region of the wagon body (door frame). The rod is coupled to another articulation point of the hinged plate and is connected to the first locking bracket and moves it, and the subsequently arranged locking brackets into the locking position or unlocking position.

If the swinging sliding door is equipped with a two-wing door, two coupling rods are coupled to the lever which is attached to the vertical shaft, said coupling rods each being connected to the respective vertical rod via a hinged plate.

The stops for limiting the rotational movement of the segment plate, the traction rod which is coupled to it and the pivoted lever which is connected to said rod are mounted on a plate or a carrier element. This provides a compact and space-saving arrangement.

In a further refinement of the invention, the possibility of manual emergency unlocking by means of at least one Bowden cable as traction means is provided. For this purpose, a spring-loaded pivoted lever is arranged as first lever in the upper region of the door frame, at least one traction means engaging on said lever. The first lever is connected via a second lever, which is preferably embodied as a clip, to a third lever, the third lever being attached to the axial shaft of a spring-loaded rotary magnet and having elongate holes in which a bolt is displaceably mounted. When the traction means is subjected to tensile loading, the bolt engages with a fourth lever, pivotably mounted on a shaft, and moves it. The fourth lever is operatively connected via at least one horizontally arranged coupling rod and deflection unit to the locking rod which can be moved in the vertical direction. A rod, via which a force component which brings about the locking and unlocking of the door leaves is temporarily applied, also engages on the fourth lever.

Both the functional element for the emergency unlocking, the first pivoted lever to which the Bowden cable is coupled, and the third lever, as well as the fourth pivoted lever which is responsible for the locking/unlocking, are mounted together on a plate or a carrier element.

In order to decouple the emergency unlocking means, the third lever, which is securely connected to the elongate holes, with a vertically downwardly directed shaft which lies on the axis of rotation of this lever. The shaft is connected to a spring-loaded rotary magnet which in the state in which voltage is applied when current is supplied, moves the lever in the counterclockwise direction, and as a result the bolt disengages from the claw-shaped recess of the pivoted lever.

The locking and unlocking device can be used both for single-wing and two-wing swinging sliding doors, and ensures a high degree of functional reliability. It is also advantageous that said device requires only a small installation space in the region of the wagon body, and the individual assemblies can be manufactured cost-effectively according to the principle of a kit system.

In further summary, at least one engagement element is provided on the inside of the door leaf or of the door at a defined distance from the inside of the door, and a spring-loaded locking hasp be arranged horizontally opposite the latter on the inside of the door frame. The locking hasp has a semicircular or claw-shaped recess and a locking section which projects laterally beyond the recess. On the inside of the door frame, a locking element is movably guided and is connected to at least one rod which can be moved in the vertical direction. During the closing movement of the door leaves or of the door, the engagement element engages with the recess of the locking hasp, and as a result of the pressing movement of the door leaf or of the door the locking hasp swings with its locking section in the direction of the center of the door opening and assumes a position extending parallel to the door leaf and is locked in this position by a movement of the locking element which is triggered in the vertical direction.

Other features which are considered as characteristic for the invention are set forth in the appended claims.

Although the invention is illustrated and described herein as embodied in a locking and unlocking device for vehicle doors, in particular swinging sliding doors for rail vehicles, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

The two-wing swinging sliding door which closes the door opening is composed of two door leaves 1*a* and 1*b*, the outsides of which form, in the closed state, a plane with the outside wall of the vehicle. In order to carry out the opening and closing movements of the door leaves, the following solution is preferably used according to the example shown.

Figure 1:
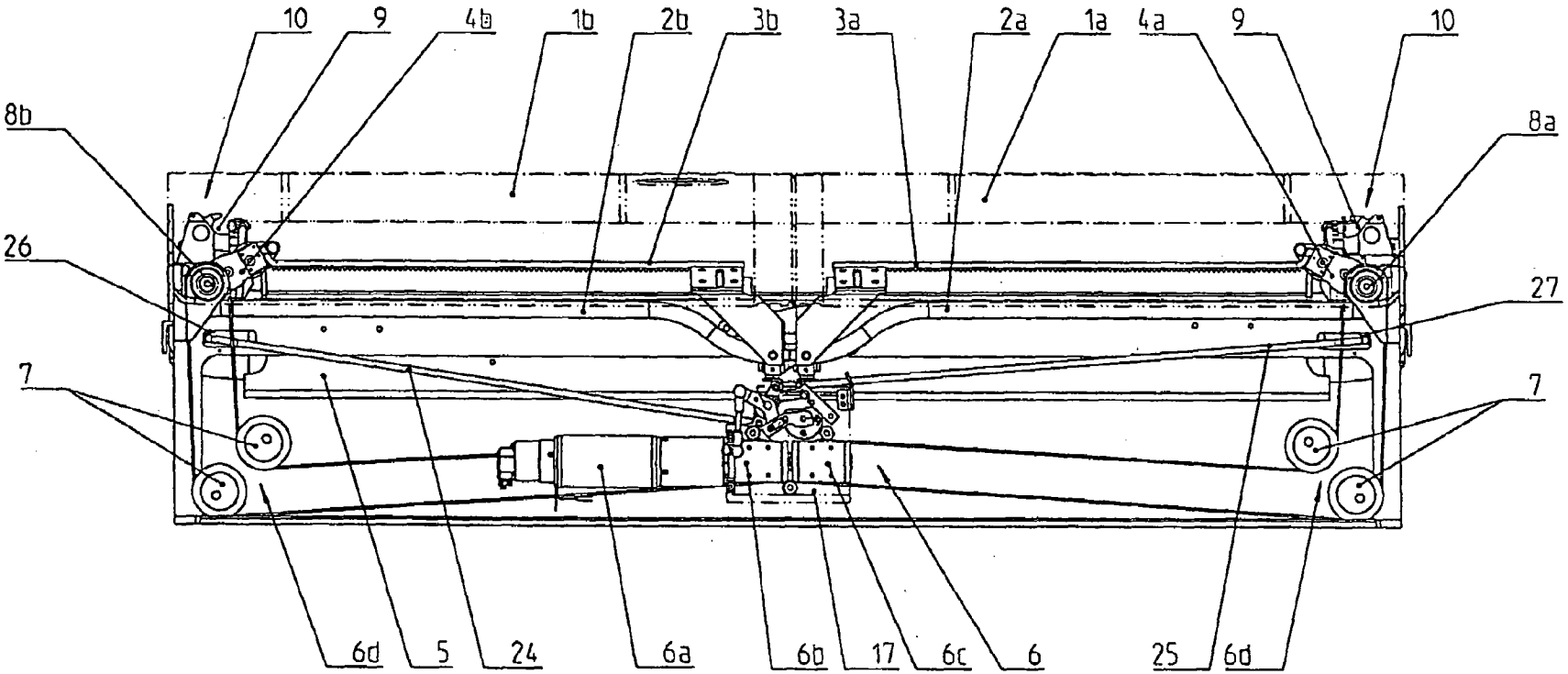
FIG. 1 is a plan view of a two-wing swinging sliding door in the installed and closed state.

The door leaves 1*a*, 1*b* are attached in the upper region to the roller carriage and are guided in one curved roller guide 2*a* and 2*b* each (FIG. 1). In order to displace the door leaves in the transverse and longitudinal directions, toothed racks 3*a* and 3*b* are attached to them in the upper and lower regions and are formed with curved initial sections and engage with slewing gears 4*a* and 4*b*. Furthermore, in the upper region of the wagon body there is a drive unit 6 which is mounted on a base plate 5 and is composed of a horizontally arranged DC motor 6*a* which uses two conical gear mechanisms 6*b*, 6*c* and a toothed belt gear mechanism 6*d* to bring about an opposed movement at the connecting shafts to the crown gears 6*e*, 6*f*. The drive torque is transmitted from the crown gears 6*e*, 6*f* of the conical gear mechanism 6*b*, 6*c* to the synchronizing disks of the upper slewing gear mechanisms 4*a*, 4*b* by the toothed belt gear mechanism 6*d* via tensioning pulleys 7 in each case. The tensioning pulleys are located on a tensioning device which is attached to the base plate 5. The two conical gear mechanisms 6*b*, 6*c* are connected to one another via a clutch. The torque is transmitted from the DC motor 6*a* to the transmission shaft by means of a passive spring connection. The motor housing can thus be rotated about its axis. The synchronously operating slewing gears which are movably mounted on the respective vertical connecting shafts 8*a*, 8*b* are each arranged in a housing. The connecting shafts 8*a*, 8*b* are if necessary adapted by means of articulated connections of the contour of the outer wall of the vehicle.

Figure 2:
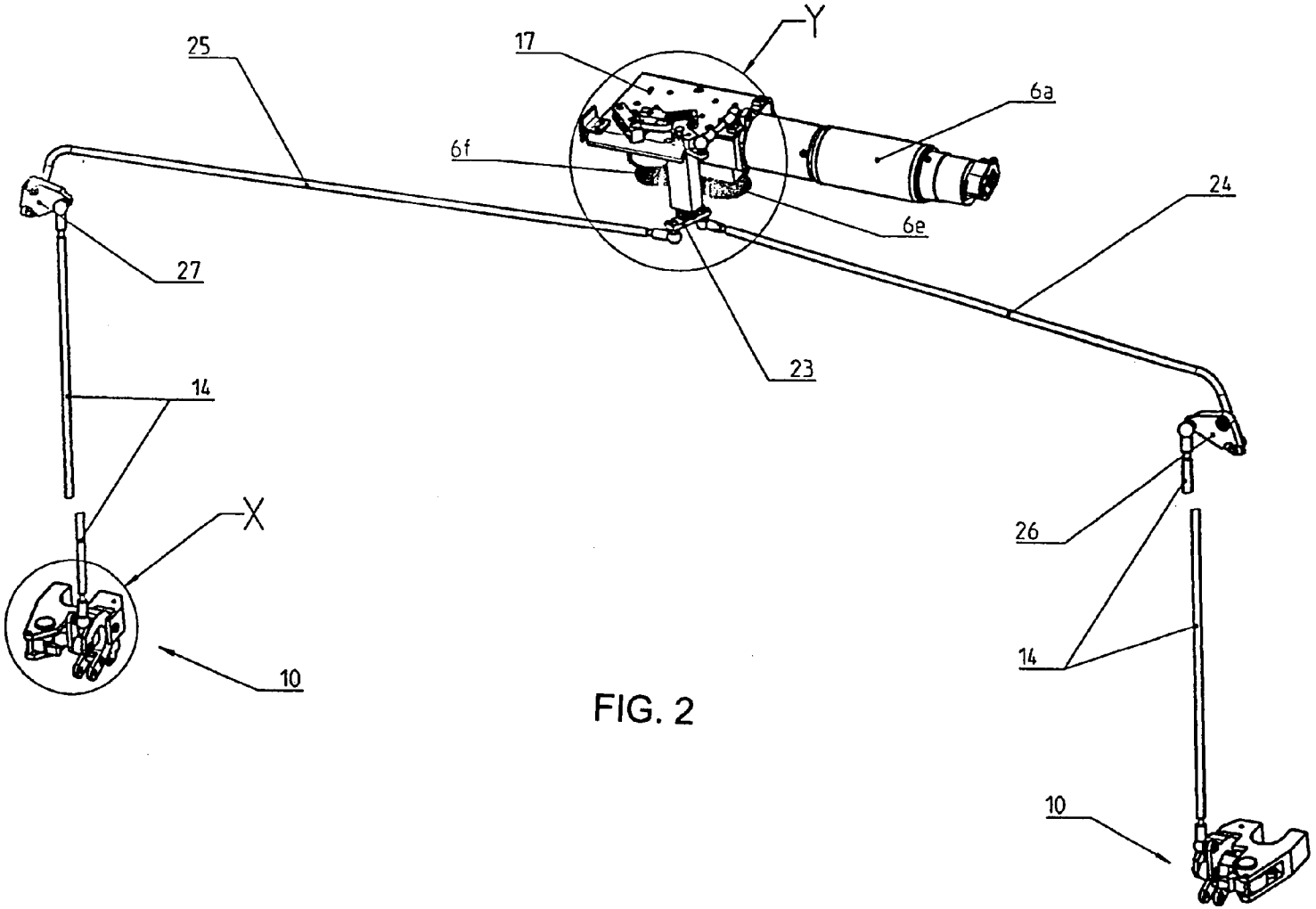
FIG. 2 is a front perspective view of the locking and unlocking mechanism which is arranged on the door frame, with the associated drive for the swinging sliding door according to FIG. 1.
Figure 3:
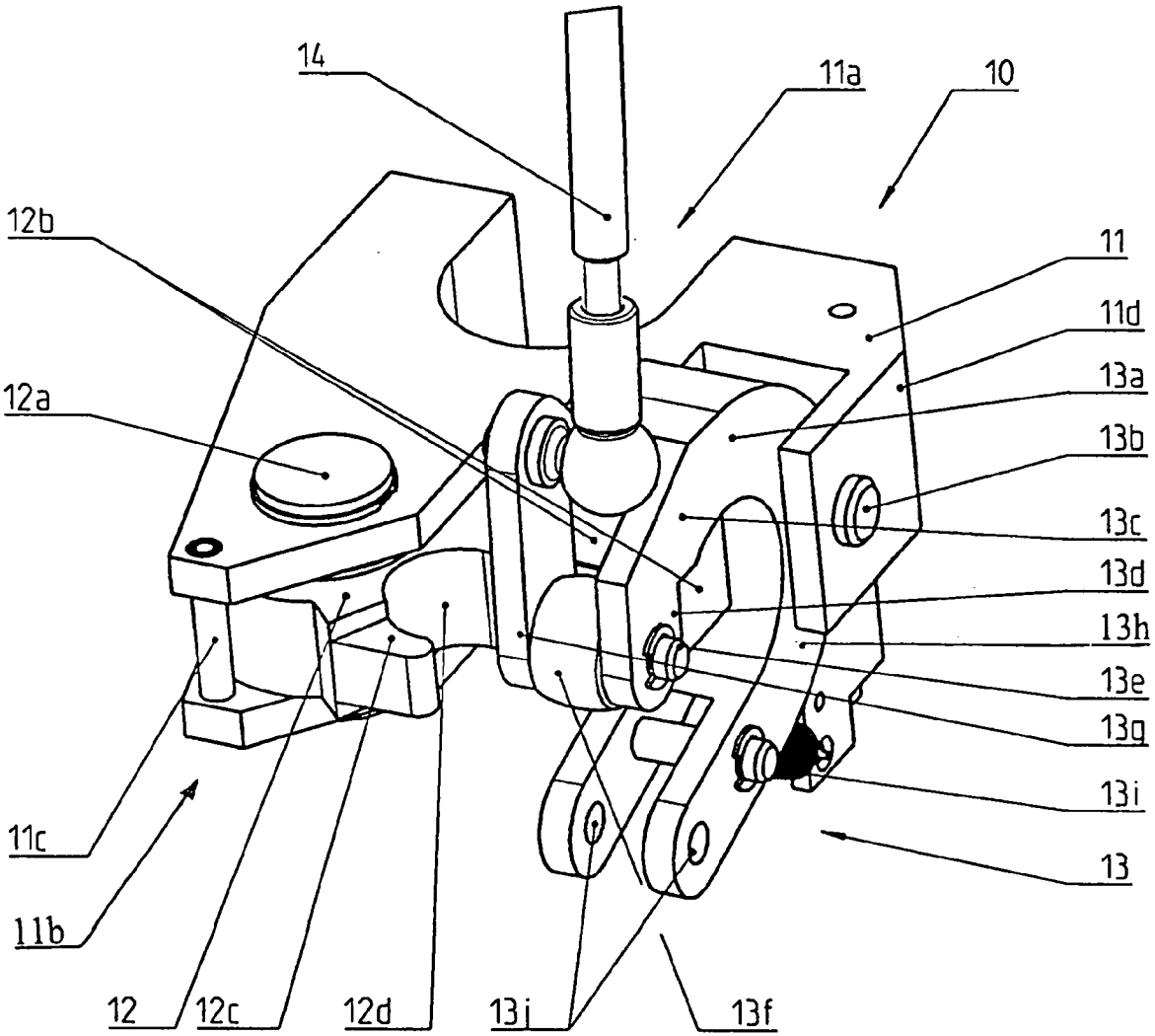
FIG. 3 shows the detail "X" according to FIG. 2 in an enlarged view.
Figure 4:
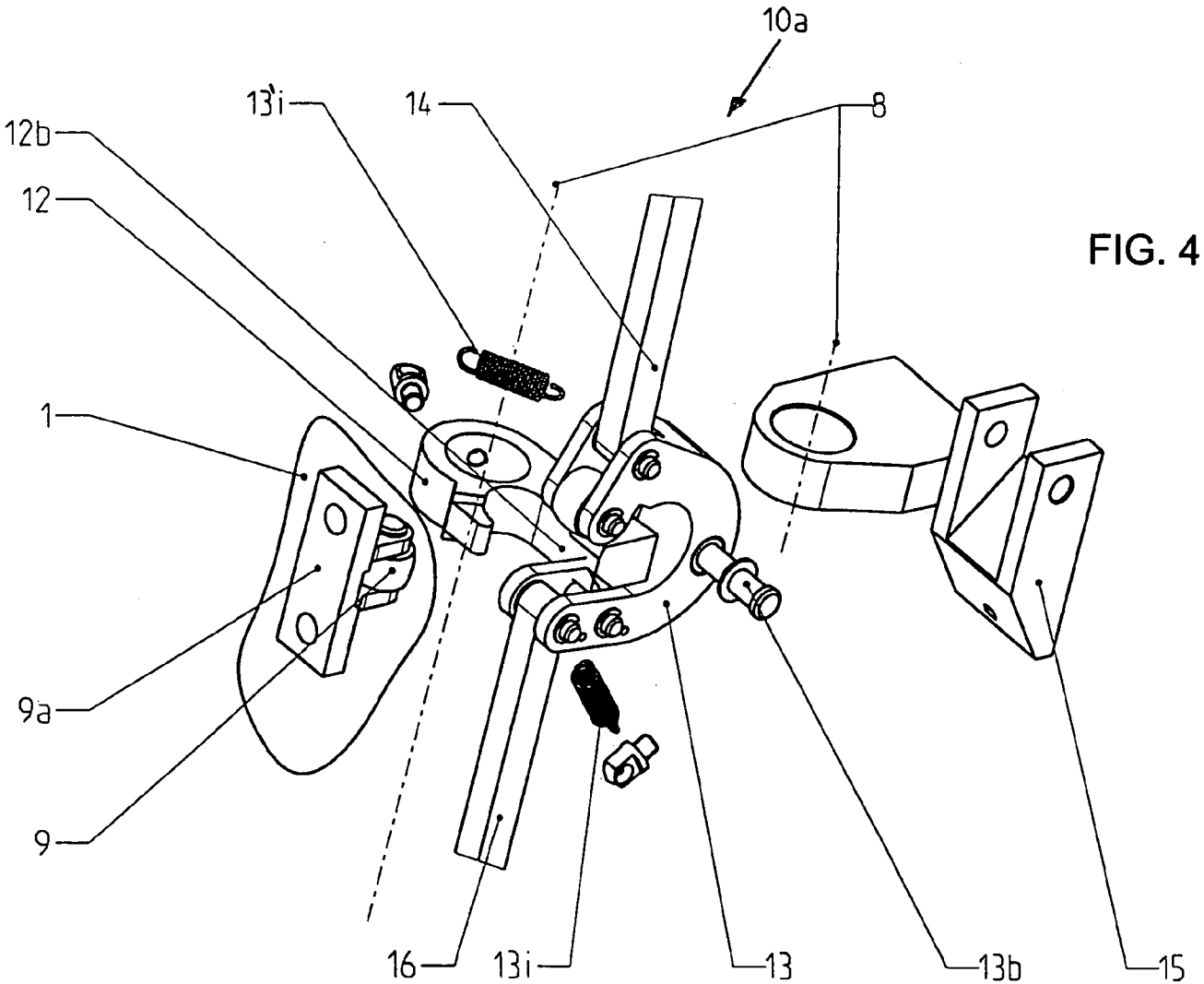
FIG. 4 is a simplified exploded view of a further embodiment variant for a locking element which is arranged on the door frame.

In the closed state of the door leaves, the slewing gears 4*a*, 4*b* are in a home position in which they extend approximately parallel to the longitudinal center axis of the vehicle. In said home position, the supporting roller of the slewing gear 4*a*, 4*b* lies in the radius of the curved initial section of the toothed rack 3*a*, 3*b*. By rotation of the drive pinion of the slewing gear 4*a*, 4*b* which engages with the toothed rack 3*a*, 3*b*, the drive pinion moves along the curved initial section and in doing so presses the respective door leaf 1*a*, 1*b* transversely out of the plane of the side wall—about the axis of the supporting roller located opposite—and in to the displacement position for the subsequent longitudinal displacement of the door leaf. In the process, one of the slewing gears 4*a* is swung about the vertical axis in the clockwise direction through an angle of approximately 90° as far as a stop, and the other slewing gear 4*b* is swung in the opposite direction. The rotational movement of the drive pinion is thus converted into a translatory movement transversely and longitudinally with respect to the longitudinal center axis of the vehicle, and as a result the respective door leaf 1*a*, 1*b* is moved out of the plane of the side wall and at the same time slightly in the longitudinal direction. The longitudinal displacement of the door leaves 1*a*, 1*b* parallel to the outer wall of the vehicle, until the door opening is completely cleared, is brought about by the further rotational movement of the pinion of the slewing gears 4*a*, 4*b* which engages with the straight section of the toothed rack 3*a*, 3*b*. In a manner known per se, the door leaves 1*a*, 1*b* are attached to roller carriages which are guided in curved roller guides 2*a*, 2*b* which are attached to the wagon body in a stationary fashion. The method of transverse and longitudinal displacement of the door leaves explained above is known from DE 101 16 580 A1. In order to lock and unlock the door leaves 1*a*, 1*b*, the necessary locking elements 10 are located on the external vertical longitudinal sides of the respective closing edges, as can be seen in FIG. 2. The complete structure of a first embodiment variant of the locking means which is arranged on the inside of the door frame is shown in FIG. 3. On the inside of the door leaves 1*a*, 1*b* there is at least one vertically guided roller 9, which is held at a defined distance from the inside of the door leaf 1*a*, 1*b* in a mount 9*a*. A corresponding detail of the door leaf of a door 1 or door leaf 1*a*, 1*b* with a roller 9 is shown in FIG. 4. The actual locking element 10 is arranged opposite on the inside of the door frame and is also shown as an individual part in FIG. 3. A mount 11 which has a rear recess 11*a* within which the vertical connecting shaft 8*a* or 8*b* (not illustrated in FIG. 3) extends is attached to the inside of the door frame. A spring-loaded locking hasp or a latch 12, or a spagnolet, is mounted so as to be capable of pivoting horizontally about the axis 12*a* of rotation on the protruding section 11*b*, front left in the viewing direction, of the mount 11. The swinging movement of the locking hasp 12 toward the outside is limited by a stop 11*c*. The locking hasp 12 has a protruding or projecting locking body or section 12*b* and opposite this a lug 12*c*, said body or section 12*b* and lug 12*c* bounding a semicircular or claw-shaped recess 12*d*. The claw-shaped recess 12*d* encloses the roller 9 which is arranged on the inside of the door leaf 1*a* during the locking process. The locking section 12*b* is significantly longer than the lug 12*c*. The tension spring (not shown in FIG. 3) for the locking hasp 12 is coupled to the rear section of the mount 11 and ensures that, in the unlocked state, the locking hasp 12 is swung against the stop 11*c* and is located in a position which is ready for engagement for the subsequent locking process. In order to finally lock the respective door leaf in the closed position, a locking bracket 13 is arranged on the mount 11. Said locking bracket 13 is pivotably mounted with its bent section 13*a* in a lateral component piece 11*d* of the mount 11 by means of a horizontal bolt 13*b*. The upper limb 13*c* of the bracket 13 has, at its front end, a downwardly directed angled portion 13*d* on which a movable roller 13*f* is mounted by means of a bolt 13*e*, the bolt 13*e* being connected in the manner of a rotary joint by means of a lever arm 13*g* to a vertically arranged locking rod 14. A tension spring 13*i*, which is connected to the mount 11, is coupled to the lower limb 13*h* of the locking bracket 13. In order to lock the door leaf in the closed position (in said position the locking section 12*b* of the locking hasp 12 is in a parallel position to the door leaf), the locking bracket 13 is swung about its axis 13*b* of rotation by the spring force of the tension spring 13*i*, as a result of which the roller 13*f* is moved directly in front of the locking section 12*b* of the locking hasp 12 and locks it. This locking process can additionally also be additionally supported by the triggered movement of the locking rod 14 in the downward direction.

Release of the lock, that is to say unlocking, is not brought about again until the locking bracket 13 is swung in the clockwise direction into home position by activation of the locking rod 13 in the opposite, upward direction, and the locking hasp 12 can easily be moved out of the region with the locking bracket 14 in the outward direction (in the clockwise direction) by a swinging movement.

At the front end of the lower limb 13*h* of the locking bracket 13 there are two bores 13*j* which lie on a common axis and they have the purpose of receiving a bolt for attaching a bar for transmitting the vertical movement to a further locking element for the locking and unlocking processes.

A further embodiment variant of a locking element for multiple locking, which is preferably applied in single-wing swinging sliding doors, is shown in FIG. 4. The door leaf or the door 1 also has vertically arranged rollers 9 which lie on a common longitudinal axis on the inside and are mounted in a mount 9*a* which is attached to the door leaf 1. Opposite said rollers 9 there are, in the region of the inside of the door frame, spring-loaded locking hasps 12 and locking brackets 13 which interact with them. The locking hasps are mounted at corresponding vertical intervals so as to be freely pivotable on the vertical connecting shaft 8 in order to transmit the drive movement from the upper slewing gear to the lower slewing gear. In FIG. 4, only one locking element 10*a* is shown and the connecting shaft 8 is indicated only by a dashed line. In a mount 15, which is attached to the inside of the door frame, a spring-loaded locking bracket 13 is pivotably mounted on a horizontally arranged bolt 13*b*. The upper limb of the locking bracket 13 of the locking element 10*a*, which is at the first position in the order from top to bottom, is connected to a locking rod 14, in a way which is analogous to the embodiment according to FIG. 3. The lower limb is connected via a vertical rod 16 to the upper limb of the subsequent locking bracket 13. All the other brackets 13 are connected to one another via corresponding rods 16. In FIG. 4, some of the components have not been provided with reference symbols for reasons of clarity since said symbols have already been specified for identical components in FIG. 3. In FIG. 4, 13'*i* designates the spring for the locking hasp 12 which is attached to it and to the mount 15.

The method of operation of the locking system is identical in both embodiment variants.

During the closing movement of the door or the door leaves, the vertically guided roller 9 which is located on the inside of the door engages with the semicircular or claw-shaped recess 12*d* of the locking hasp 12. The locking hasp 12 is swung further in the direction of the center of the door opening, in the counterclockwise direction, by the pressing movement of the door in the direction of the closing edge which is brought about by the guide. In this context, the roller 13*f* of the locking bracket 13 is in contact with the upper face of the locking section 12*b* and rolls on it. The locking section 12*b* is swung into the opening of the bracket 13. After a position parallel to the door or door leaf is reached, the locking bracket 13 is swung downward about its axis 13*b* of rotation by the applied spring force, and the roller 13*f* moves directly in front of the locking section 12*b*. In this state, the final locking position is reached.

On the rotary column or the vertical connecting shaft 8, 8*a*, 8*b*, a pin (not shown in the drawing), which is moved along with the rotary column during the opening of the door or door leaves and locks the locking hasp in the opened position of the door or door leaves so that the latter can no longer be moved manually back again into its locked position, is additionally arranged. The necessary activation elements for the locking and unlocking including the manually trippable emergency unlocking process and decoupling of the emergency unlocking means are mounted on a mounting plate 17 which is arranged underneath the base plate 5 and which is attached to the base plate 5 via spacer elements (not shown), FIGS. 1, 2 and 5.

The reaction force of the drive motor 6*a*, whose motor housing can be rotated about its axis, can be used to trigger the necessary movements for the unlocking process directly before the opening movement of the door leaves or the support for the locking process during the closing movement of the door leaves 1*a*, 1*b*.

Figure 5:
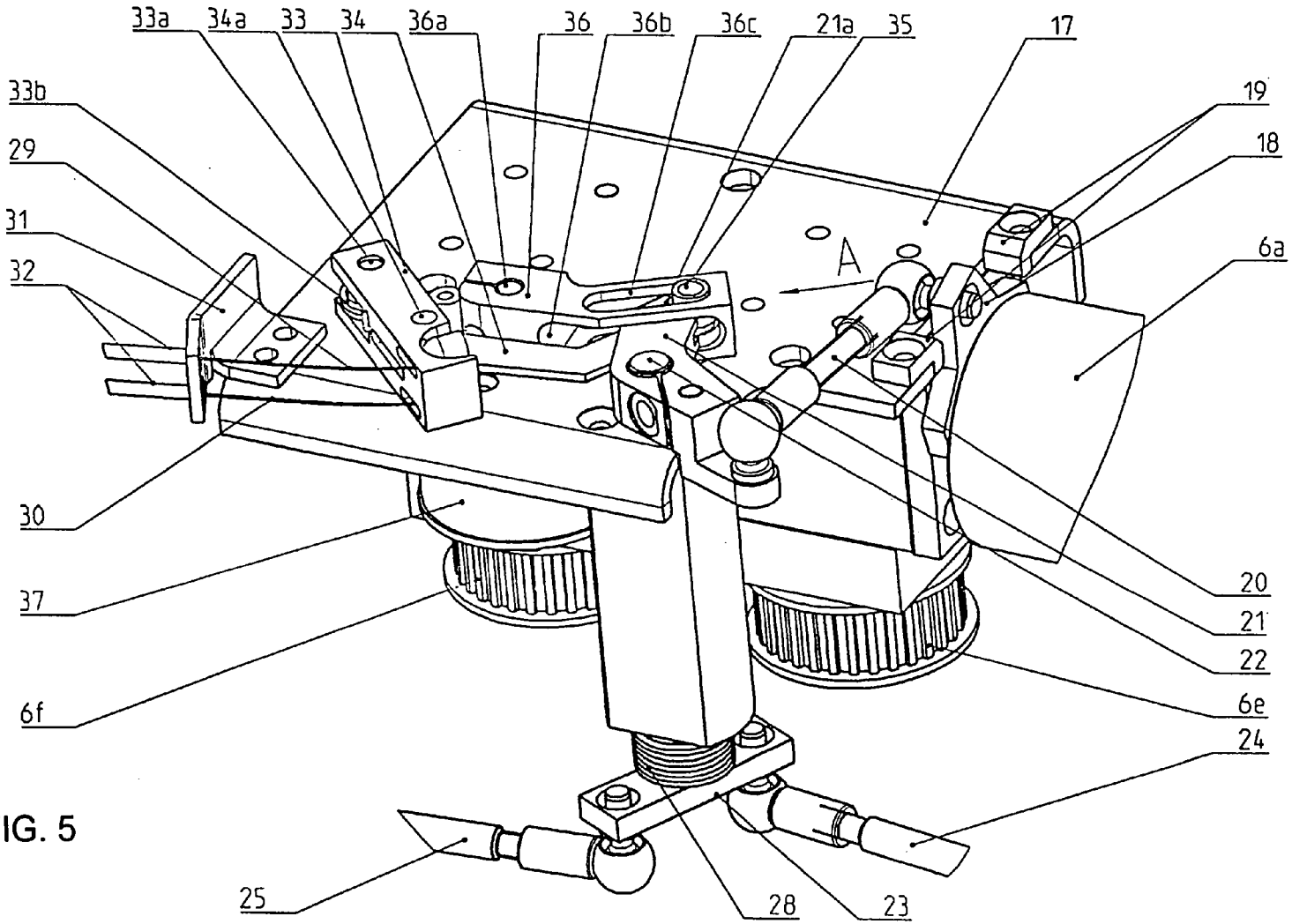
FIG. 5 shows the detail "Y" according to FIG. 2 in an enlarged view.

The rotary movement of the housing of the motor 6*a* which is arranged in the horizontal installation position is transmitted to a segment plate 18 which is connected to the motor housing. The segment plate 18 is guided in a lateral recess of the mounting plate 17 and projects beyond the mounting plate 17. The rotary movement of the segment plate 18 is limited by two stops 19 which are attached to the mounting plate 17 (FIG. 5). A traction rod 20 is attached in the manner of a rotary joint to the upwardly projecting section of the segment plate 18, said traction rod 20 transmitting the rotary movement of the motor housing to a horizontal lever 21 which is attached to the mounting plate 17 in the manner of a rotary joint. The pivoted lever 21 is connected at its axis of rotation to a rigid, vertically downwardly directed shaft 22 which is stressed by means of a rotary spring 28. A lever 23, to which the movement of the traction rod 20 is transmitted via the pivoted lever 21 and the shaft 22, is attached centrally to the lower end of the shaft 22. Horizontally arranged coupling rods 24 and 25 are coupled to the two ends of the lever 23 and the rotary movements of the lever 23 are converted into linear movements by means of said rods. The coupling rods 24 and 25 which are arranged offset with respect to one another extend, as shown in FIGS. 1 and 2, into the region of the outer closing edges of the door frame, and are bent downwards at their ends and coupled to triangular hinged plates 26, 27 which are rotatably mounted in the upper region of the wagon body. The respective locking rods 14, by means of which the movement of the locking brackets 13 is triggered, are coupled to the third pivot point of the hinged plates 26 or 27.

In the closed state of the door leaves 1*a*, 1*b*, said door leaves are also locked to the two outer closing edges. The locking hasp 12 is in engagement with the rollers 9 which are arranged on the inside of the door leaves, and the locking brackets 13 are pulled downward by the spring force of the traction springs 13*i* which engage on them, and the rollers 13*f* are located directly before the locking section 12*b* of the locking hasps 12. The pivoted lever 21 which is attached to the mounting plate 17 is secured in the locked position by the rotary spring 28.

The unlocking process is initiated by the door opening instruction. The drive energy which is generated when the DC motor 6*a* is activated is transmitted by the conical gear mechanisms 6*b*, 6*c*, the toothed belt gear mechanism and the slewing gears 4*a*, 4*b* to the toothed racks 3*a*, 3*b* which are attached to the door leaves 1*a*, 1*b*. The slewing gears 4*a*, 4*b* generate, in conjunction with the outwardly bent section of the toothed racks 3*a*, 3*b*, a force which counteracts the locking process, constituting the blocking process by means of the locked door leaves. This blocking process generates a reaction torque at the DC motor, as a result of which the housing of the motor 6*a* rotates about the drive axis. This rotary movement is transmitted to the toothed rack 20 via the segment plate 18, and the pivoted lever 21 is rotated in the counterclockwise direction, overcoming the applied spring force. The rotary movement of the pivoted lever 21 is transmitted via the vertical shaft 22 to the lever 23, as a result of whose rotary movement in the counterclockwise direction the coupling rods 24 and 25 which are coupled to the latter execute a linear pulling movement and as a result the respective vertical locking rods 14 are raised by the hinged plates 26 and 27, and the locking brackets 13 swing upward about their axis 13*b* of rotation and clear the locking hasp 12 or its locking section 12*b*. With the blocking of the movement of the door leaves 1*a*, 1*b* having now been released, the transverse displacement and subsequent longitudinal displacement of the door leaves is completed by the combination of the slewing gear/toothed rack and the drive energy of the motor. In the process, the rollers 9 on the inside of the door disengage from the locking hasp 12 which rotates in the clockwise direction as far as the stop 11*c* as a result of the applied spring force.

During the closing process, the locking takes place in the reverse order, the locking movement being brought about primarily by the spring force which is applied to the locking bracket 13.

A manual emergency unlocking means which is necessary for safety reasons is also provided. It is embodied either as an emergency unlocking handle with a square latching means or an emergency unlocking button. In this context it is also possible to integrate the external emergency unlocking means in the door leaf. A Bowden cable is attached in each case as traction means to the emergency activation device. The Bowden cables 29, 30, one of which is intended for the inside of the door and the other for the outside of the door, are guided as far as the mounting plate 17 and are held in guides 32 in a mount 31 which is attached to the mounting plate 17, and are attached to a spring-loaded pivoted lever 33 and stressed by it. The axis of rotation of the first lever, the pivoted lever 33 is indicated by 33*a*, and the rotary spring by 33*b*. On the pivoted lever 33, a bent clip 34 is secured, as a second lever, in the manner of a rotary joint about the axis 34 of rotation, offset with respect to the pivoting axis 33*a*. At the end of the clip 34 which lies opposite the axis 34*a* of rotation, a vertically oriented bolt 35, which is operatively connected to a third lever 36, is arranged so as to be capable of rotating in said clip 34. This lever 36 is attached to a shaft 36*a* which forms the vertical axis of rotation, so as to be capable of rotating on the mounting plate 17. The lever 36 has a cutout which serves as a horizontal guide 36*b*. In the upper and lower component pieces of the lever 36 which bound the cutout, there are two congruent elongate holes 36*c* in which the bolt 35 of the clip 34 is displaceably guided. The two elongate holes 36*c* thus form a vertical guide for the bolts 35 of the clip 34. The spring-loaded, fourth lever, the pivoted lever 21, which is arranged, as already explained, on the mounting plate 17 and is operatively connected to the traction rod 20, has, at its end lying opposite the coupling point of the traction rod 20, a semicircular or claw-shaped recess 21*a* which engages with the bolt 35, both in the locked and unlocked state of the lock. In order to ensure that the bolt 35 engages in the recess 21*a*, the lever 36 is operatively connected to the spring of the rotary magnet 37.

In addition, a decoupling means for emergency unlocking is also provided. For this purpose, a spring-loaded rotary magnet 37 is located on the downwardly extended shaft 36*a* of the lever 36. The emergency unlocking means is decoupled by a signal which is triggered by the door controller and by which the rotary magnet is supplied with electrical voltage and rotates the shaft 36, and thus the lever 36, in the counterclockwise direction.

The method of operation of the emergency unlocking means and the decoupling means is as follows.

By manually activating the emergency handle on the inside or outside of one of the doors, the pivoted lever 33 is rotated in the clockwise direction by means of the respective Bowden cable, and the clip 34 is thus moved along and the bolt 35 which is positively guided in the elongate holes 36*c* is displaced in the direction indicated by an arrow A. Since the bolt 35 engages with the pivoted lever 21, the latter is rotated in the counterclockwise direction about its pivoting axis, and thus moves the coupling rods 24 and 25 by means of a shaft 22 and the lever 23, said coupling rods triggering the unlocking by means of the rods 14, as already explained in detail.

In order to bring about decoupling, the rotary magnet 37 is supplied with voltage and rotates the shaft 36*a*, and thus the lever 36 in the counterclockwise direction, as a result of which the bolt 35 disengages from the claw-shaped recess 21*a* of the pivoted lever 21. In this state, the emergency unlocking means is decoupled, and when the emergency unlocking means is activated the pivoted lever 21 is no longer moved and the locked state continues.

If the emergency unlocking means is to be activated again, the supply of voltage to the rotary magnet 27 is interrupted and the lever 36 is moved back again into its home position by the applied spring force, and in the process the bolt 35 engages again with the claw-shaped recess 21*a* of the pivoted lever 21.

We claim:

1. A locking and unlocking device for a swinging sliding door on a vehicle, wherein the swinging sliding door in a closed state thereof is provided in a sidewall plane of the vehicle in a door frame, the device comprising;

at least one engagement element disposed on an inside of the door, at a defined spacing distance from the inside of the door and substantially laterally inside the door, said engagement element being engageable from behind, and pointing in a lateral direction of the door;

a locking unit disposed in a mount at the inside of the door frame in a region of a vertical longitudinal side of a closing edge of the door, the locking unit including:

a horizonatally pivotable spring-loaded locking hasp disposed opposite said engagement element inside the door frame, said locking hasp having a semicircular or claw-shaped recess formed therein and a locking section protruding laterally over said recess;

during a closing movement of the door, via a pressing movement in the lateral direction, said locking section engaging said engagement element from behind, said engagement element engaging said recess of said locking hasp, and said locking hasp assuming a position extending parallel to the door; and a locking element movably guided on an inside of the door frame and connected to at least one rod movably disposed in a vertical direction, and in a closed state of the door, said locking element engaging said locking section for locking said locking hasp.

2. The locking and unlocking device according to claim 1, wherein said locking hasp is mounted on a vertical drive shaft.

3. The locking and unlocking device according to claim 2, which comprises a traction spring connected to said mount and attached to said looking hasp.

4. The looking and unlocking device according to claim 1, wherein said locking element is a bracket having a bent section, limbs, and an opening, said locking element is rotatably mounted at said bent section on a horizontally arranged shaft in a mount attached to the inside of the door frame, wherein said opening of said bracket points in a direction of said door, and one of said limbs of said bracket has an angled portion directed toward said opening of said bracket and having a roller rotatably mounted on a horizontal shaft, and wherein at least an upper limb of said limbs is connected to a vertically movable rod, and a traction spring connected to said mount is attached to said bracket.

5. The locking and unlocking device according to claim 4 configured as a multiple locking device, wherein individual said brackets are movably connected to one another by way of vertically aligned rods coupled to said limbs.

6. The locking and unlocking device according to claim 1, which comprises a stop disposed to limit a movement of said locking hasp in one rotary direction.

7. The locking and unlocking device according to claim 1, wherein said engagement element is a roller disposed in a vertical guide of a mount.

8. The locking and unlocking device according to claim 1, which further comprises a drive motor with a housing, and a segment plate for activating said at least one vertically movable rod, said segment plate being attached to said housing and, owing to a reaction force of the drive, performing a rotational movement limited by two stops, and further comprising a traction rod coupled to the segment plate for transmitting the rotational movement to a spring-loaded pivoted lever, said pivoted lever being rigidly connected to a shaft having attached thereto a lever, said lever being in contact with at least one horizontal coupling rod, said coupling rod being articulated at a hinged plate arranged in an upper region of door frame and connected to said rod.

9. The locking and unlocking device according to claim 8, configured for a two-wing door, and comprising two coupling rods articulated to said lever and each connected to said rod by way of a respective hinged plate.

10. The locking and unlocking device according to claim 8, wherein said stops, said traction rod and said pivoted lever are mounted on a plate or a carrier element.

11. The locking and unlocking device according to claim 1, wherein, for enabling manual emergency unlocking, at least one traction device engages on a first spring-loaded pivoted lever connected via a second lever to a third lever, wherein said third lever is attached to an axial shaft of a spring-loaded rotary magnet and is formed with elongate holes in which a bolt is displaceably mounted, wherein said bolt engages, when said traction means is subjected to tensile stress, with a fourth lever pivotably mounted on a shaft, and said bolt moves said lever, wherein a fourth lever is operatively connected via at least one horizontal coupling rod and deflection unit to a locking rod that is movable in the vertical direction, and wherein a rod, for enabling an application of a force component bringing about locking and unlocking of the door to be temporarily applied, engages on said fourth lever.

12. The locking and unlocking device according to claim 11, wherein said first lever and said third lever define functional element for emergency unlocking and said fourth lever is a functional element responsible for locking/unlocking, and wherein said first lever, said third lever, and said fourth lever are pivoted levers mounted on a horizontal plate or a carrier element.

13. The locking and unlocking device according to claim 12, wherein, in order to decouple emergency unlocking means, said third lever is rigidly attached to a vertically downwardly directed shaft defining an axis of rotation, and said shaft is connected to a spring-loaded rotary magnet, wherein, when said rotary magnet is energized, said third lever is movable in a counter-clockwise direction and, as a result, said bolt disengages from a claw-shaped recess of said fourth lever.

14. The locking and unlocking device according to claim 1, configured for single-wing or two-wing swinging sliding doors of a rail vehicle.

* * * * *